United States Patent [19]

Stange

[11] 4,352,552

[45] Oct. 5, 1982

[54] MULTICOLOR DEVELOPMENT SYSTEM FOR ELECTROPHOTOGRAPHIC PRINTING MACHINES

[75] Inventor: Klaus K. Stange, Pittsford, N.Y.

[73] Assignee: Xerox Corporation, Stamford, Conn.

[21] Appl. No.: 162,988

[22] Filed: Jun. 25, 1980

[51] Int. Cl.[3] ..... G03G 15/01; G03G 15/08

[52] U.S. Cl. ..... 355/4; 118/203; 118/657; 118/661; 355/3 DD

[58] Field of Search ..... 355/3 R, 3 DD, 4; 118/203, 657, 658, 661

[56] References Cited

U.S. PATENT DOCUMENTS

| | | | |
|---|---|---|---|
| 3,584,601 | 6/1971 | Turner | 118/657 |
| 3,641,969 | 2/1972 | Hakanson | 118/658 X |
| 3,749,050 | 7/1973 | Hastwell | 118/203 X |
| 3,854,449 | 12/1974 | Davidson | 355/3 DD X |
| 3,870,017 | 3/1975 | Kratcoski et al. | 355/3 DD X |
| 4,139,296 | 2/1979 | Ruckdeschel | 355/3 DD |
| 4,226,524 | 10/1980 | Hashimoto | 355/3 DD |
| 4,226,525 | 10/1980 | Sakamoto et al. | 355/3 DD X |
| 4,286,544 | 9/1981 | Witte | 118/657 |

*Primary Examiner*—Fred L. Braun

[57] ABSTRACT

An apparatus which develops a latent image. At least two differently colored developer materials are transported to a position closely adjacent to the latent image. One of the developer materials is selectively removed from the region of the latent image. In this way, the other developer material develops the latent image.

5 Claims, 6 Drawing Figures

MULTICOLOR DEVELOPMENT SYSTEM FOR ELECTROPHOTOGRAPHIC PRINTING MACHINES

This invention relates generally to a multicolor electrophotographic printing machine, and more particularly concerns an improved development system for use therein.

Generally, the process of electrophotographic printing includes charging a photoconductive member to a substantially uniform potential to sensitize the surface thereof. The charged portion of the photoconductive surface is exposed to a light image of the original document being reproduced. This records an electrostatic latent image on the photoconductive member corresponding to the informational areas contained within the original document. After the electrostatic latent image is recorded on the photoconductive member, the latent image is developed by bringing the developer material into contact therewith. This forms a powder image on the photoconductive member which is subsequently transferred to a copy sheet. Finally, the powder image is heated to permanently affix it to the copy sheet in image configuration.

Multicolor electrophotographic printing records a series of different electrostatic latent images on the photoconductive member. Each latent image corresponds to a particular color in the original document. In such a system, there is a need to develop each of the latent images, i.e. single color latent images, with toner particles complimentary in color to the color of the filtered light image transmitted to the photoconductive surface. Thus, in multicolor electrophotographic printing, a plurality of developer units are required. Each developer unit furnishes the appropriately colored toner particles to the latent image. If all of the developer units are continuously in operation, each latent image will be developed with toner particles from each of the developer units. Hence, the colors are intermingled with one another resulting in the toner powder image being miscolored and the colors of the copies not corresponding to those of the original document. It is apparent that only one developer unit may be in operation at any given time. Various types of development systems have been designed to achieve the foregoing. The following disclosures appear to be relevant:

U.S. Pat. No. 3,854,449,
Patentee: Davidson,
Issued: Dec. 17, 1974.
Co-pending U.S. patent application Ser. No. 844,681
Applicant: Green et al.
Filed Oct. 25, 1977
Co-pending U.S. patent application Ser. No. 80,650
Applicant: Stange
Filed: Oct. 1, 1979

The pertinent portions of the foregoing disclosures may be briefly summarized as follows:

Davidson describes a development system wherein successive developer units are articulated into operative communication with the electrostatic latent image recorded on the photoconductive member.

Green discloses a magnetic brush development system used in a multicolor electrophotographic printing machine in which the direction of rotation of the developer roller is reversed so as to move the developer material away from the latent image.

Stange discloses a developer roller comprising a plurality of spaced magnetic strips which enable the developer material to pass to the interior thereof.

In accordance with the features of the present invention, there is provided an apparatus for developing a latent image. The apparatus includes means for transporting at least two differently colored developer materials to a position closely adjacent to the latent image. Means are provided for selectively removing one of the developer materials from the transporting means so as to develop the latent image with the other developer material.

Other aspects of the present invention will become apparent as the following description proceeds and upon reference to the drawings, in which.

While the present invention will hereinafter be described in conjunction with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
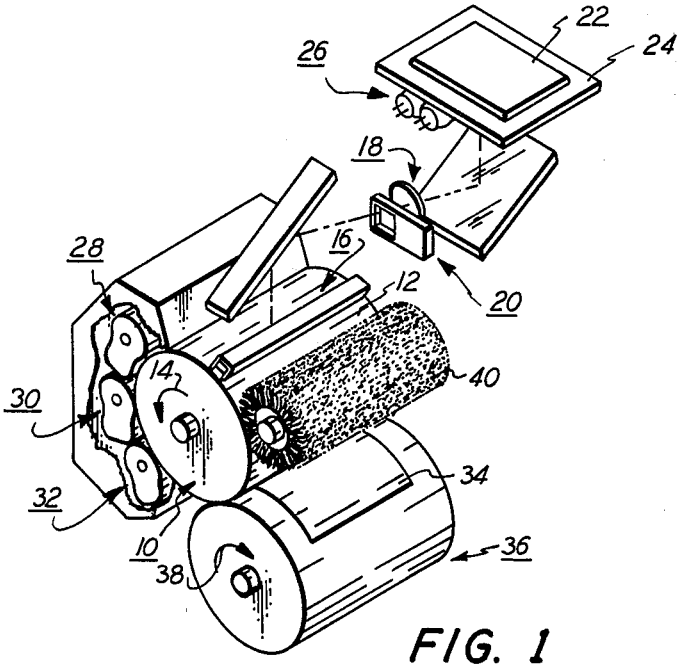
FIG. 1 is a schematic elevational view depicting an electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the development system of the present invention therein. It will become evident from the following discussions that the development system described hereinafter is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

Referring now to FIG. 1, the printing machine employs a photoconductive member comprising a drum 10 having a photoconductive surface 12 entrained about and secured to the circumferential surface of a conductive substrate. Preferably, photoconductive surface 12 is formed from a material having a relatively panchromatic response to white light. A suitable type of photoconductive material is described in U.S. Pat. No. 3,655,377 issued to Sechak in 1972. The conductive substrate of drum 10 is preferably made from aluminum. Drum 10 rotates in the direction of arrow 14 to move photoconductive surface 12 sequentially through a series of processing stations.

Initially, photoconductive surface 12 passes through the charging station A which has positioned thereat a corona generating device, indicated generally by the reference numeral 16. Corona generating device 16 charges at least a portion of photoconductive surface 12 to a relatively high, substantially uniform potential. A suitable corona generating device is described in U.S. Pat. No. 3,875,407 issued to Hayne in 1975.

The charged portion of photoconductive surface 12 is next rotated to the exposure station. At the exposure station, a moving lens system, generally designated by the reference numeral 18, and a color filter mechanism, shown generally at 20, cooperate with one another to form a single color light image. A suitable lens system is described in U.S. Pat. No. 3,592,531 issued McCrobie in 1971. U.S. Pat. No. 3,775,006 issued to Hartman et al. in 1973 discloses a suitable filter mechanism. A single color light image irradiates the charged portion of photoconductive surface 12. This single color light image is formed from an original document 22 supported stationarily upon transparent viewing platen 24. This permits successive incremental areas of original document 22 to be illuminated by moving lamp assembly 26. Lens system 18 is adapted to scan successive incremental areas of original document 22. The light rays reflected from original document 22 pass through lens 18 and filter mechanism 20. Lamp assembly 26, lens system 18 and filter mechanism 20 move in a relationship with photoconductive surface 12 to produce a non-distorted flowing light image of the original document. Filter mechanism 20 interposes selected color filters into the optical light path of lens 18. The color filters operate on the light rays passing through lens 18 to record an electrostatic latent image on photoconductive surface 12 corresponding to a specific color of the informational areas contained within the original document.

After the electrostatic latent image is recorded on photoconductive surface 12, drum 10 rotates to the development station. The development station includes three developer units, generally designated by the reference numerals 28, 30 and 32, respectively. Each developer unit is of a type generally designated as a magnetic brush system. In a magnetic brush development system, a magnetizable developer mix of carrier granules and toner particles is continually brought through a directional flux field to form a brush of developer material. The developer mix is continually moving to provide fresh material to the brush. The developer mix includes magnetic carrier granules having non-magnetic toner particles clinging thereto by triboelectric attraction. This chain-like array simulates the fibers of a brush. Development is achieved by having the developer mix brush across the electrostatic latent image recorded on the photoconductive surface. The electrostatic latent image attracts the toner particles from the carrier granules forming a toner powder image on photoconductive surface 12. Each of the developer units 28, 30 and 32, respectively, deposit toner particles on the electrostatic latent images which are adapted to absorb light within a preselected spectral region of the electromagnetic wave spectrum corresponding to the wave-length of light transmitted through the filter. For example, a latent image formed by passing the light image through a green filter will record the red and blue regions of the spectrum as areas of relatively high charge density on photoconductive surface 12, while the green light rays will pass through the filter and cause the charge density on photoconductive surface 12 to be reduced to a voltage level ineffective for development. The charged areas are then made visible by applying green absorbing (magenta) toner particles to the latent image. Similarly, a blue separation is developed with blue absorbing (yellow) toner particles, with a red separation being developed with red absorbing(cyan) toner particles. The detailed structural configuration of developer units 28, 30 and 32, respectively, will be discussed hereinafter with reference to FIGS. 2 through 4, inclusive.

After development, the now visible toner powder image is moved to the transfer station. At the transfer station, the toner powder image is transferred to a sheet of support material 34, such as plain paper, amongst others. This is achieved by an electrically biased transfer roll, shown generally by the reference numeral 36, having sheet 34 secured releasably thereon for movement in a recirculating path therewith, i.e. in the direction of arrow 38. The surface of transfer roll 36 is electrically biased to a potential having a magnitude and polarity sufficient to electrostatically attract toner particles from photoconductive surface 12 to sheet 34. Transfer roll 36 rotates in synchronism with drum 10 so that successive toner powder images may be transferred from photoconductive surface 12 to support material 34, in superimposed registration with one another.

Referring briefly to the sheet feeding path, a stack of sheets of support material 34 are disposed on a tray. The uppermost sheet is advanced into a chute by a feed roll cooperating with a retard roll. The chute guides the advancing sheet into the nip between register rollers. The register rollers forward the sheet to gripper fingers on transfer roll 36. After a plurality of toner powder images have been transferred to sheet 34, the fingers space sheet 34 from transfer roll 36. As transfer roll 36 continues to rotate, a stripper bar is interposed between the sheet and the transfer roll. The sheet of support material passes over the stripper bar onto a conveyor. The conveyor moves sheet 34 to a fusing station.

At the fusing station, a fuser permanently affixes the toner powder image to the sheet of support material. A suitable fuser is described in U.S. Pat. No. 3,907,492 issued to Draugelais et al. in 1975. After the toner powder images are permanently affixed to the sheet of support material, sheet 34 is advanced by endless belt conveyors to a catch tray for subsequent removal from the printing machine by the operator.

The last processing station in the direction of rotation of drum 10, as indicated by arrow 14, is a cleaning station. At the cleaning station, a rotatably mounted fibrous brush 40 contacts photoconductive surface 12. In this way, residual toner particles remaining on photoconductive surface 12 after transfer are removed therefrom.

It is believed that the general operation of an electrophotographic printing machine incorporating the features of the present invention therein have been amply described by the foregoing. Referring now to the specific subject matter of the present invention, FIG. 2 depicts a development system employed in the FIG. 1 printing machine in greater detail.

Figure 2:
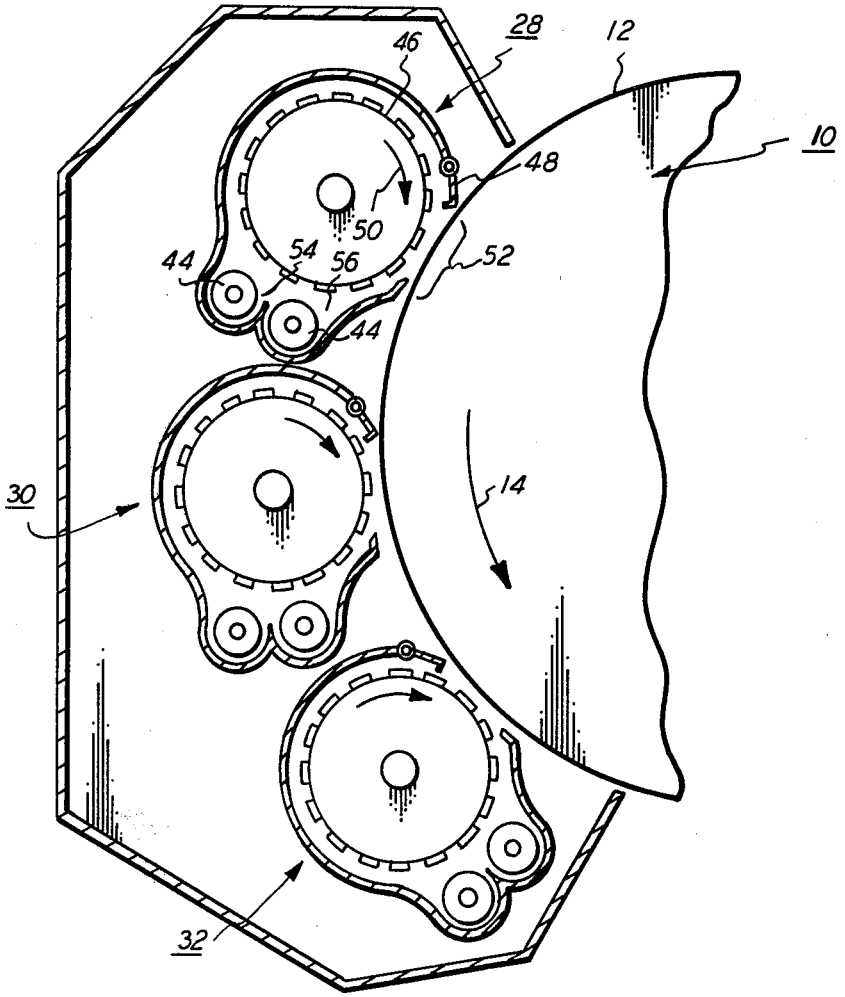
FIG. 2 is a schematic elevational view showing the development system used in the FIG. 1 printing machine.

Turning now to FIG. 2, there is shown a multi-color development system having three developer units 28, 30 and 32, respectively. Each developer unit is depicted in an elevational sectional view to indicate more clearly the various components contained therein. Only developer unit 28 will be described hereinafter in detail, inasmuch as developer units 30 and 32 are substantially identical thereto. The distinctions between developer units are relatively minor and merely relate to the different colored toner particles contained therein and geometric differences due to the mounting angle.

The principle components of developer unit 28 are developer housing 42, crossmixers 44, and developer roller 46. Blade member 48 is mounted pivotally on housing 42. When developer unit 28 is operative, blade member 48 is pivoted so that the leading edge thereon is remote from developer roller 46. When developer unit 28 is inoperative, blade member 48 is pivoted to position the leading edge thereof closely adjacent to developer roller 46. In this way, developer material is removed therefrom. This prevents any developer material on developer roller 46 from being deposited on the electrostatic latent image recorded on photoconductive surface 12 of drum 10. In operation, augers 44 comprise helical springs positioned in tubular members. The augers serve to mix the developer material. Furthermore, the augers may also furnish additional toner particles to the system when a toner particle concentration detecting system indicates that additional toner particles are required within the developer mixture. Developer roller 46 rotates in the direction of arrow 50 to advance the developer material to development zone 52. Development zone 52 is located between photoconductive surface 12 and developer roller 46. The latent image recorded on photoconductive surface 12 is developed by contacting the moving developer mix. Developer housing 42 defines a chamber 54 for storing a supply of developer material 56 therein. As developer roller 46 rotates in the direction of arrow 50, it transports developer material 56 into contact with photoconductive surface 12 of drum 10. The developer material is magnetically attracted to the developer roller. The electrostatic latent image recorded on the photoconductive surface of drum 10 attracts the toner particles from the carrier granules so as to form a toner powder image thereon. One of the characteristics of developer roller 46 is self-leveling. As the developer material contacts photoconductive surface 12, the extraneous developer material passes through the spaces in developer roller 46 and returns to chamber 54 for subsequent reuse. When the complete latent image recorded on photoconductive surface 12 has passed development zone 52, development is discontinued by removing developer material from contact with photoconductive surface 12. This insures that the developer material from one developer unit will not effect subsequent images which are developed in different colors by other developer units. To achieve this, blade 48 is pivoted so that the leading edge thereof is closely adjacent to developer roller 46. Furthermore, developer roller 46 is de-energized and no longer rotates in the direction of arrow 50. In this way, the developer material adhering to developer roller 46 is removed from the vicinity of development zone 52. Thus, developer roller 46 becomes de-nuded of developer material. Photoconductive surface 12 is no longer in contact with any developer material. This permits the next successive developer unit to be actuated so as to deposit toner particles on the next successive electrostatic latent image. Preferably, developer unit 28 deposits yellow toner particles on the electrostatic latent image while developer unit 30 deposits magenta toner particles and developer unit 32 cyan toner particles. The detailed structure of developer roller 46 will be described hereinafter with reference to FIG. 3 with the detailed structure of blade 48 being described hereinafter with reference to FIG. 4.

Figure 3:
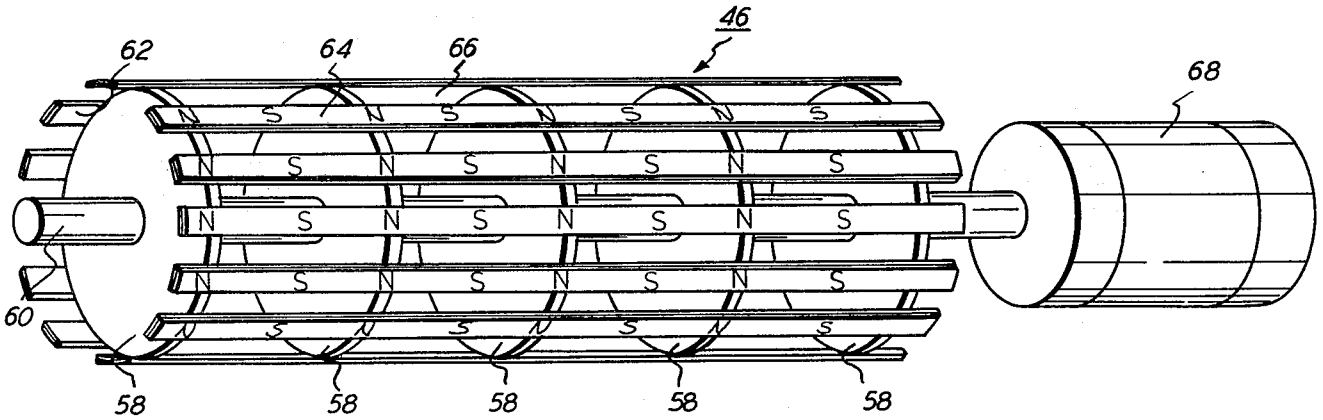
FIG. 3 is a schematic perspective view illustrating the transport roller used in the FIG. 2 development system.

Referring now to FIG. 3, there is shown the detailed structure of developer roller 46. As shown in FIG. 3, a plurality of discs 58 or spoked plates are fastened to a common shaft 60. Bars 62 are supported by discs 58. Permanent magnetic strips 64 are secured to bars 62. Bars 62 are preferably substantially equally spaced from one another defining spaces 66 therebetween. In addition, bars 62 extend in a direction substantially parallel to the longitudinal axis of shaft 60. Preferably, bars 62 are made from a soft magnetic iron which provides sufficient stiffness and support to hold magnetic strips 64 secured thereto. Magnetic strips 64 may be secured adhesively to bars 62. Spaces 66 permit the developer material to pass into the interior of developer roller 46. This allows through mixing of the toner particles with the carrier granules and permits extraneous developer material to escape from the nip between drum 10 and developer roller 46, i.e. in development zone 52 (FIG. 2). This provides for a gentle development action which significantly improves the life of the photoconductive surface. In addition, it allows for the extraneous developer material to return to the supply of developer material in chamber 54 of housing 42. Motor 68 is coupled to shaft 60 so as to rotate developer roller 46 in the direction of arrow 50. Preferably, motor 68 rotates developer roller 46 at a substantially constant angular velocity. A voltage source is coupled by a suitable means such as slip rings to shaft 60. Inasmuch as discs 58 and bars 62 are electrically conductive, the voltage source electrically biases developer roller 46 to a suitable potential and magnitude. Preferably, the voltage source electrically biases developer roller 46 to a voltage level intermediate that of the background and image areas. Each magnetic strip 64 has a series of magnetic poles of alternating polarity impressed thereon. Adjacent magnetic strips have magnetic poles of the same polarity opposed from one another. In addition, each magnetic strip is preferably electrically conductive. The electrical conductivity of the magnetic strips may be achieved by various techniques. For example, the magnetic material may be made conductive by adding carbon thereto or ceramic magnets may be employed. Alternatively, the magnetic strips may be made from rubber magnets overcoated with a stainless steel foil or a carbon paint to provide the requisite conductivity. Preferably, magnetic strips 64 are made from barium ferrite.

In operation, as a magnetic strip 64 moves out of the developer material disposed in chamber 54 of housing 42, the outer surface thereof will be covered with a fairly uniform layer of developer material 56. As magnetic strip 64 moves into development zone 52, the developer material will be pulled through the development zone. The developer material which has difficulty in passing through the development zone, is merely pushed into the spaces 66 between adjacent magnetic strips 64. Hence, a self-leveling feature is produced to provide gentle toning of the latent image. This self-leveling feature permits large amounts of developer material to be transported into the development zone without creating unmanageable build-ups thereof. After the magnetic strip has passed through the development zone, the remaining developer material will be partially exchanged for new developer material as the strip passes, once again, through the developer material in the chamber of the housing. The detailed structure of developer roller 46 is disclosed in copending U.S. patent application Ser. No. 80,650, filed Oct. 1, 1979, the relevant portions thereof being hereby incorporated into the present application. When developer roller 46 is inoperative, blade member 48 is pivoted from a position wherein the leading edge thereof is remote from magnetic strips 64 to a position wherein the leading edge is closely adjacent thereto. In this way, the developer material is removed from developer roller 46 so that subsequent electrostatic latent images recorded on photoconductive surface 12 of drum 10 are developed by the next successive developer unit, i.e. developer unit 30. At this time, both developer unit 28 and 32 are inoperative. The detailed structure of blade member 48 will be shown hereinafter with reference to FIG. 4.

Figure 4:
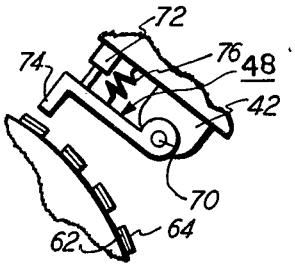
FIG. 4 is a schematic elevational view depicting the cleaning system used in the FIG. 2 development system.

Referring now to FIG. 4, there is shown blade member 48 positioned to have the leading edge thereof closely adjacent to magnetic strips 64. Blade member 48 has end 70 secured pivotably to housing 42. Actuation of solenoid 72 pivots blade 48 to position the leading edge 74 thereof closely adjacent to magnetic strip 64. The de-energization of solenoid 72 permits spring 76 to pivot blade 48 so as to position leading edge 74 thereof remotely from magnetic strip 64.

Figure 5:
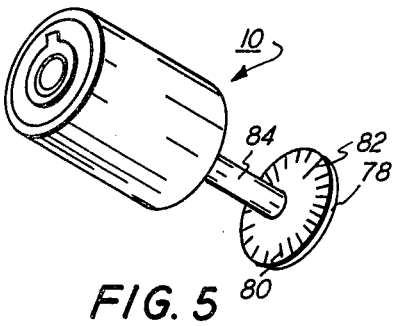
FIG. 5 is a schematic perspective view showing the timing system of the FIG. 1 printing machine.

The timing scheme for determining energization of solenoid 72, which, in turn, pivots blade 48, is shown in FIG. 5. As shown in FIG. 5, disc 78 includes a plurality of slits 80 each having a predetermined angular orientation with respect to reference slit 82. Slit 82 is of a pre-determined orientation with respect to the location of drum 10. Thus, each slit 80 corresponds to a precise angular orientation of drum 10. Disc 78 is mounted on shaft 84 coupled directly to drum 10. Hence, rotation of drum 10 rotates disc 78 so as to define the angular orientation of drum 10 relative thereto. After the first electrostatic latent image is recorded thereon, developer unit 28 is actuated in response to one of slits 80 reaching a predetermined angular orientation. Subsequent developer units 30 and 32 are energized thereafter for development of the next successive electrostatic latent images.

Figure 6:
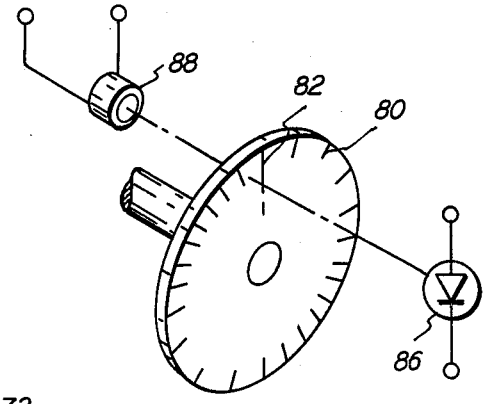
FIG. 6 is a schematic perspective view illustrating the sensing system for the FIG. 5 timing system.

As shown in FIG. 6, each slit is sensed by the utilization of a light emitting diode 86 positioned on one side of timing disc 78 and photosensor 88 positioned on the other side thereof. Diode 86 projects light rays through the slits in disc 78 with photosensor 88 being positioned to receive the light rays transmitted therethrough. In this way, a series of electrical pulses are generated as drum 10 rotates and the occurence, in time, of these pulses is related to the angular position of drum 10 with respect to slit 82. These pulses comprise an event clock signal. A similar light emitting diode and photosensor (not shown) are also provided and positioned on opposite sides of disc 78 near slit 82 for generating a single signal termed a pitch signal for each complete revolution of drum 10. Each slit develops an output signal to initiate an event. The various machine events occur at different logic times. In this manner, a signal is developed indicating initiation of development as one of the slits passes between diode 86 and photosensor 88. After a predetermined number of slits have passed between diode 86 and photosensor 88, development is terminated. Thus, the machine logic counts the number of pulses generated to initiate development at a prescribed drum angular orientation and to subsequently terminate development after drum 10 has rotated through a predetermined angle. The electrical signals are processed by suitable logic circuitry and employed to actuate solenoid 72 so as to position the leading edge 74 of blade 48 closely adjacent to magnetic strip 64 to terminate development of the respective developer unit. In this manner, only one developer unit is energized at any given time so as to deposit single color toner particles on the respective electrostatic latent image. This prevents intermingling of differently colored toner particles.

In recapitulation, it is apparent that the development system of the present invention removes the developer material from developer units not being employed. This insures that only one developer unit at a given time is actuated to develop the respective electrostatic latent image. In this way successive differently colored powder images are formed on successive latent images. These powder images are then transferred to a copy sheet, in superimposed registration, to produce a colored copy of the original document.

It is, therefore, evident that there has been provided in accordance with the present invention, an apparatus for developing an electrostatic latent image that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for developing a latent image, including:

a first transport roller comprising a plurality of magnetic strips for attracting at least one of two differently colored developer materials thereto, and means for movably supporting said magnetic strips with adjacent magnetic strips being parallel to and spaced from one another to define a cylindrical configuration and to enable developer material to pass therebetween, said supporting means moving said magnetic strips to transport the attracted developer material closely adjacent to the latent image;

a second transport roller spaced from said first transport roller, said second transport roller comprising a plurality of magnetic strips for attracting the other of the developer materials thereto, and means for movably supporting said magnetic strips with adjacent magnetic strips being parallel to and spaced from one another to define a cylindrical configuration and to enable developer material to pass therebetween, said supporting means moving said magnetic strips to transport the other of the developer materials closely adjacent to the latent image;

a first blade member arranged to move from an inoperative position in which the leading edge thereof is remote from said first transport roller to an operative position in which the leading edge thereof is closely adjacent to said first transport roller to remove developer material therefrom; and a second blade member arranged to move from an inoperative position in which the leading edge thereof is remote from said second transport roller to an operative position in which the leading edge thereof is closely adjacent to said second transport roller to remove developer material therefrom, said second blade member being in the inoperative position in response to said first blade member being operative.

2. An apparatus according to claim 1, wherein:

said supporting means of said first transport roller includes at least a pair of spaced apart discs, and a plurality of spaced apart bars connecting said pair of discs to one another with each of said plurality of bars being arranged to support one of said magnetic strips; and said supporting means of said second transport roller includes at least a pair of spaced apart discs, and a plurality of spaced apart bars connecting said pair of discs to one another with each of said plurality of bars being arranged to support one of said magnetic strips.

3. An apparatus according to claim 2, wherein:

said plurality of bars of said first transport roller are substantially equally spaced from one another; and said plurality of bars of said second transport roller are substantially equally spaced from one another.

4. An apparatus according to claim 3, wherein:

each of said plurality of bars of said first transport roller are connected to the outer periphery of said discs to define a cylindrical configuration; and each of said plurality of bars of said second transport roller are connected to the outer periphery of said discs to define a cylindrical configuration.

5. An apparatus according to claim 4, further including:

first means for rotating said first transport roller so as to develop the latent image with one of the developer materials; and second means for rotating said second transport roller with said first transport roller being substantially stationary so as to develop the latent image with the other of the developer materials.

* * * * *